US006526597B1

(12) United States Patent
Shepard

(10) Patent No.: US 6,526,597 B1
(45) Date of Patent: Mar. 4, 2003

(54) WAISTBAND STAY FOR CLOTHING

(76) Inventor: Kevin D. Shepard, 129 Beechwood Dr., Burns, TN (US) 37029

( * ) Notice: Subject to any disclaimer, the term of this patent is extended or adjusted under 35 U.S.C. 154(b) by 0 days.

(21) Appl. No.: 10/072,940

(22) Filed: Feb. 12, 2002

(51) Int. Cl.[7] ..... E03D 11/00
(52) U.S. Cl. ..... 2/255; 2/236
(58) Field of Search ..... 2/236, 235, 227, 2/228, 238, 220, 221, 255, 256, 257, 258, 259, 263, 222, 223, 311, 312, 336, 338; 450/109, 139, 143, 144, 145

(56) References Cited

U.S. PATENT DOCUMENTS

| | | | | |
|---|---|---|---|---|
| 1,579,306 A | * | 4/1926 | Goldsmith | 2/255 |
| 2,614,261 A | | 10/1952 | McTighe | |
| 2,769,979 A | | 11/1956 | Driesbach | |
| 2,830,300 A | | 4/1958 | Schwartz | |
| 3,030,633 A | | 4/1962 | Chalfin | |
| 3,042,932 A | * | 7/1962 | Eppy | 2/235 |
| 3,194,242 A | * | 7/1965 | Marchisella | 450/144 |
| 3,351,954 A | * | 11/1967 | Chalfin et al. | 450/144 |
| 3,394,410 A | | 7/1968 | Liebowitz | |
| 3,531,807 A | * | 10/1970 | Devito et al. | 2/255 |
| 3,723,993 A | | 4/1973 | Ruby | |
| 3,800,332 A | | 4/1974 | Forrest | |
| 3,848,269 A | | 11/1974 | Forrest | |
| 3,854,147 A | | 12/1974 | Duffy | |
| 4,364,125 A | * | 12/1982 | de Riz et al. | 2/255 |
| 5,544,366 A | | 8/1996 | Kato | |
| 5,638,550 A | | 6/1997 | Hube | |
| 5,802,619 A | | 9/1998 | Ralston et al. | |
| 5,867,836 A | | 2/1999 | Quinones | |
| 6,202,221 B1 | | 3/2001 | Ackley, Jr. | |
| 6,253,384 B1 | | 7/2001 | Valentino | |

FOREIGN PATENT DOCUMENTS

| | | |
|---|---|---|
| GB | 1392199 | 4/1975 |

* cited by examiner

*Primary Examiner*—Gloria M. Hale
(74) *Attorney, Agent, or Firm*—Richard C. Litman

(57) ABSTRACT

A waistband stay for clothing inserts removably into the waistband of a pair of trousers, a dress or skirt, a pair of shorts, etc., and stiffens the waistband thereacross. This serves to prevent circumferential gathering, wrinkling, and the like of the waistband along the front and sides thereof due to compression of the fabric across the stomach or midriff of a person as the person sits, stoops, or otherwise bends forward at the waist. The present waistband stay is preferably formed of an elongate, narrow, thin piece of semi-flexible plastic which provides sufficient stiffness across its width to preclude folding of the waistband when installed therein. The use of the present waistband stay ensures that the waistband of the garment will remain unwrinkled and will provide a smooth and finished appearance for the article of clothing and for the wearer throughout the day.

20 Claims, 4 Drawing Sheets

WAISTBAND STAY FOR CLOTHING

BACKGROUND OF THE INVENTION

1. Field of the Invention

The present invention relates generally to accessories for clothing and apparel, and more specifically to a concealed, semi-rigid stay which may be inserted removably into the waistband of a pair of trousers, a skirt, dress, or other garment. The present stay provides some additional stiffness across the width of the waistband of the garment, thus precluding wrinkling and creasing of the waistband and providing a smooth, finished appearance for the waistband and the wearer of the garment.

2. Description of the Related Art

Personal appearance is of some importance in almost every human society and culture. In most societies, the wearer of even informal clothing and apparel is expected to have a neat and clean appearance, and most persons make at least some attempt toward providing a neat and tidy appearance with their clothing.

While styles come and go, there has been a tendency toward less formality in business and other situations in the U. S. A. Even the wearing of jeans and other informal wear is accepted in many areas and environments now, which environments would have required more formal attire in the recent past.

In many cases, such informal apparel does not require certain accessories (e. g. belts, etc) which might be expected or required with the wearing of more formal attire. Depending upon the cut and fit of such apparel, in many cases the fit around the waist and hips can be sufficiently good, that no belt is required. In other cases, the trousers or other apparel includes sufficient elasticity at the waist, that no belt is required. This is not only true of mens' trousers and apparel, but can be true of womens, wear (skirts, dresses, slacks, etc.) as well.

One drawback to such beltless attire is that the waistband often tends to gather or "bunch up" in the vertical direction, i.e., across its width, with no belt extending therearound to, provide some support in this direction. This is particularly true when a person is seated or bends at the waist, as the front of the apparel waistband tends to gather within the folds of the lower stomach and/or midriff area of the body as the person bends at the waist. Oftentimes, the resulting generally horizontal creases which form around the front of the waistband, tend to be set in place if the person remains seated for some time (e. g., driving, working at a desk, etc.) and remain even when the person stands, resulting in an unkempt appearance due to the waistband creases.

Accordingly, a need will be seen for a waistband stay for use with trousers, skirts, and virtually any other apparel having a waistband which might otherwise gather or crease at the waist during normal wear. The present waistband stay comprises a thin, elongate sheet of material which is flexible along its length in order to pass around and through the tubular waistband construction of most apparel, yet which is sufficiently stiff across its width as to resist bending thereacross to preclude folding and creasing of the apparel waistband. The present waistband stay is removable, and includes a draw string at one end so the user may withdraw the stay from the apparel waistband when the stay is no longer needed in the apparel, e. g., for laundering of the apparel, etc.

The present waistband stay is preferably formed of a thin plastic strip of material, which provides sufficient stiffness across the relatively short dimension of its width so as to resist bending thereacross. Yet, the material is sufficiently flexible as to allow the stay to be curved along its length to fit around the waistband of the apparel while being worn. The present waistband stay may be manufactured in virtually any color desired, or may be made of transparent or translucent material in order to provide an unobtrusive appearance in sheer fabrics, if so desired. Alternatively, thin, flexible metal material (e. g., spring steel, etc.) may be used if desired. The present stay may be marked at one end thereof to allow the user to trim the length as needed to fit his or her waistband as desired. The present disclosure also includes a method of installing and using the present stay, as well.

A discussion of the related art of which the present inventor is aware, and its differences and distinctions from the present invention, is described below.

U.S. Pat. No. 2,614,261 issued on Oct. 21, 1952 to Edward F. McTighe, titled "Tubular Cloth Casing," describes the construction of a fabric tube for stitching to another sheet of fabric, with the tube containing a stay therein. The McTighe stay is permanently secured within his stay pocket or tube, by stitching. No means is provided for temporary installation of the stay in the pocket or tube, and for removal therefrom, by McTighe. Moreover, the McTighe stay pocket or tube is not constructed as an apparel waistband and no means is seen for readily adapting the McTighe stay system to such an apparel waistband, whereas the present stay makes use of the existing tubular waistband construction in trousers or other apparel.

U.S. Pat. No. 2,769,979 issued on Nov. 13, 1956 to Gilbert O. Driesbach, titled "Non-Removable Collar Stay," describes the construction of a shirt collar incorporating a permanently installed plastic stay in each collar point. The Driesbach stays are not removable, as noted in the title of the Driesbach U. S. patent. Moreover, they do not pass longitudinally through the collar, but rather extend for only a short distance diagonally within each collar point or tip, to preclude curling of the collar points or tips. Driesbach does not provide any means of removably or otherwise installing his collar stays longitudinally through the tubular waistband of an article of apparel.

U.S. Pat. No. 2,830,300 issued on Apr. 15, 1958 to Marcus Schwartz, titled "Boning," describes the incorporation of a polyethylene plastic cap or end for conventional wire boning stays used in various womens' foundation garments. The polyethylene ends have the advantage of permitting sewing needle passage therethrough without breaking the needle. Thus, the Schwartz boning system is directed to a permanently sewn in place construction, rather than to removable stays as provided by the present invention. Moreover, Schwartz does not disclose the use of a thin, flat sheet of plastic or other material for use as a stay within the tubular waistband of an outer garment, as provided by the present invention.

U.S. Pat. No. 3,030,633 issued on Apr. 24, 1962 to William L. Chalfin, titled "Plastic Strips," describes a series of embodiments for stays which may be installed within garments. The main point of the various Chalfin embodiments is to provide stays having relatively stiff major portions, with relatively flexible end portions. The embodiment of the Chalfin U.S. patent which appears closest to the present invention is that of FIGS. 8 and 9, which includes a longitudinal slot formed through each end. Chalfin notes that this provides additional flexibility and that "the opening . . . will facilitate sewing operations." (Column 2, lines 34 and 35.) However, Chalfin states that his stays are intended to be permanently installed within garments, and makes no provision for temporary installation in or removal of any of his stay embodiments from any garment by the wearer, as provided by the present removable waistband stay invention.

U.S. Pat. No. 3,394,410 issued on Jul. 30, 1968 to Benjamin Liebowitz, titled "Laterally Flexible Stay," describes the construction of stays from continuously crimped pieces of metal (sinusoidally formed, "zig-zag," etc.). The installation of the Liebowitz stays is understood to be with the stays having their elongate axes oriented generally vertically, i. e., parallel to the height of the wearer, rather than extending circumferentially therearound, as in the present waistband stays. Liebowitz seeks a longitudinally stiff stay which may flex more easily in left to right orientation, as the Liebowitz disclosure is understood. This is opposite the present stay construction, with its flexible nature along its elongate axis allowing it to curve around the waistband of the apparel, while still providing sufficient lateral stiffness as to preclude folding or creasing of the waistband. In any event, Liebowitz does not disclose any means for temporarily installing and removing his stays from an article of apparel.

U.S. Pat. No. 3,531,807 issued on Oct. 6, 1970 to Joseph DeVito et al., titled "Twistable Plastic Garment Stay," describes a stay apparently intended to have properties much like those of the stay embodiments of the '410 U.S. patent to Liebowitz, discussed immediately above. DeVito et al. provide stay construction having relative torsional and lateral flexibility, while being relatively stiff longitudinally. In any event, DeVito et al. disclose their stay embodiments as being permanently secured within a garment, i. e., stitched in place, rather than being removable, as are the present stay embodiments.

U.S. Pat. No. 3,723,993 issued on Apr. 3, 1973 to Burton B. Ruby, titled "Trousers Waistband Structure," describes an elastic waistband assembled integrally with the trousers. The flexible elastic nature of the Ruby waistband construction, teaches away from the lateral stiffness required to accomplish the goals of the present waistband stay. In any event, Ruby does not provide any form of relatively stiff stay inserted into his waistband construction, as is clear from the cross sectional view of FIG. 3 of the Ruby '993 U.S. patent. The flexible nature of the Ruby waistband construction would allow the waistband to bunch up and gather, which actions are prevented by the present removable waistband stay.

U.S. Pat. No. 3,800,332 issued on Apr. 2, 1974 to Sanford I. Forrest, titled "Expandable Garment Waistband," describes a garment having one or more generally vertical slits across the waistband thereof. Each slit includes an elastic insert permanently stitched in place. The elastic inserts allow the waistband to stretch and extend, according to the actions of the wearer. The flexible nature of the elastic material teaches away from the relatively stiff structure of the present stays, and the Forrest waistband construction teaches further away from the present invention due to the flexible nature of the elastic material of the Forrest waistband, which would allow the waistband to fold and gather across its width under certain motions of the wearer of the garment.

U.S. Pat. No. 3,848,269 issued on Nov. 19, 1974 to Sanford I. Forrest, titled "S Expandable Garment Waistband," is a continuation in part of the '332 U. S. patent to the same inventor, discussed immediately above. The same points of difference noted between that disclosure and the present invention, are seen to apply here as well.

U.S. Pat. No. 3,854,147 issued on Dec. 17, 1974 to Edward T. Duffy, titled "Shirt Collar Construction," describes the permanent installation of a relatively stiff stay in a generally diagonal orientation within the tip of a shirt collar. The stay construction of the Duffy '147 U.S. patent more closely resembles the stay construction disclosed in the '979 U.S. patent to Driesbach, discussed further above. The same points raised in that discussion are seen to apply here as well.

U.S. Pat. No. 5,544,366 issued on Aug. 13, 1996 to Kohji Kato, titled "Elastic Waist Structure For Trousers And Skirts," describes a garment construction having one or more elastic bands installed along the waistband of the garment. The elastic bands are concealed by fabric covers in order to provide a finished appearance for the garment. While Kato states that slidable inner fabric panels "prevents formation of wrinkles or furrows outside the trousers or skirt" (Abstract), he is referring to wrinkles and creases in the length of the garment, rather than wrinkles and gathering laterally along the waistband, which his flexible elastic construction cannot prevent. Also, the Kato waistband construction is permanently assembled, rather than providing removable stays.

U.S. Pat. No. 5,638,550 issued on Jun. 17, 1997 to Paul Hube, titled "Integral, Expandable, Inflatable, Adjustable Belt," describes a tubular, pneumatic belt construction which may be permanently or removably installed with a pair of pants or the like. However, only the permanent embodiment is installed within the tubular waistband construction of the garment. The removably installed embodiment is secured to the inwardly facing surface of the waistband by a series of inwardly disposed belt loops. In any event, the Hube inflatable belt does nothing to prevent circumferential bunching and gathering of the waistband, due to its circular cross sectional shape. In contrast, the thin, flat construction of the present stay assures that the stay and waistband will remain flat at all times.

U.S. Pat. No. 5,802,619 issued on Sep. 8, 1998 to Sherise M. Ralston et al., titled "Cheerleading Skirt With Improved Waistband," describes a skirt having an elastic band within a tubular fabric waistband. The ends of the elastic are attached to inelastic fabric extensions which extend from the tubular waistband. The entire assembly comprises a permanent installation, rather than being removable, as in the case of the present stay invention. Moreover, the flexible nature of the elastic and inelastic fabric materials would do nothing to prevent circumferential creasing, gathering, and wrinkling of the waistband of the Ralston garment, whereas the laterally stiff structure of the present stays serve to prevent such circumferential creasing and wrinkling of a garment waistband in which they are installed.

U.S. Pat. No. 5,867,836 issued on Feb. 9, 1999 to Luis F. Quinones, titled "Waist Band Trouser Or Skirt Holder," describes a waistband construction in which a separate waistband is removably secured to the inner waistband of the trousers. The separate waistband includes an elastic band which allows the separate structure to remain in place around the wearer's waist as he or she sits or squats, with the trousers moving as required to accommodate the flexure of the wearer's body. The elastic then draws the trousers back to their original position when the wearer stands. The Quinones waistband structure is thus directed to controlling vertical movement of the trousers, particularly at the back, where tensile forces tend to draw down the back of the waistband when the wearer sits or bends at the waist. In contrast, the present stays prevent compressive wrinkling of the waistband particularly at the front of the garment, where such wrinkling would otherwise occur when the wearer bends at the waist.

U.S. Pat. No. 6,202,221 issued on Mar. 20, 2001 to George W. Ackley, Jr., titled "Flexible Support Stay," describes a specific stay configuration for permanent installation in a; garment. The Ackley, Jr. stay comprises a relatively flat, "zig-zag" shape and is formed of plastic, and includes tabs at the ends for sewing or stitching into the garment for permanent installation therein. While the Ackley, Jr. stay is relatively inflexible laterally, the lack of provision for removal of the stay from the article of clothing, results in some lack of utility in comparison with the present removable stay invention.

U. S. Pat. No. 6,253,384 issued on Jul. 3, 2001 to Peter J. Valentino, titled "Partial, Removable, Reusable Waistband And Its Holder," describes a waistband having an adhesive coating on each side thereof. The Valentino waistband is intended to be adhesively secured within a trouser waistband, and adhesively secures the upper garment (shirt, etc.) within the waistband of the lower garment. The Valentino adhesive waistband is only a partial device, as noted, and is intended for use at the back of the upper and lower garment interface, where tensile forces are applied which tend to pull the upper garment from the lower garment as the wearer bends at the waist. This is unrelated to the problem addressed by the present invention, wherein the present stay increases the lateral stiffness of the front and sides of a waistband to preclude gathering, creasing, and wrinkling thereof as the clothing is compressed at the front as the wearer bends or sits.

Finally, British Patent Publication No. 1,392,199 published on Apr. 30, 1975 to Umbro International Ltd., titled "Articles Of Clothing," describes the construction of a waistband having an elastic circumferential gathering along with a draw string. No stay of any rigid or semi-rigid nature is disclosed in the '199 British Patent Publication. The narrow and flexible nature of the draw string passing through the tubular waistband, does nothing to prevent the waistband from gathering and creasing circumferentially about the front and sides thereof as the wearer bends at the waist.

None of the above inventions and patents, either singly or in combination, is seen to describe the instant invention as claimed.

SUMMARY OF THE INVENTION

The present invention is a waistband stay for use with trousers, dresses, slacks, skirts, and other apparel having a waistband structure which tends to gather or "bunch up" at the front of the apparel when the wearer sits or bends at the waist. The present waistband stay comprises a thin, flat, elongate sheet of semi-flexible material, which resists bending across the relatively short dimension of its width. The present waistband stay inserts into the flat, tubular structure of the typical or conventional waistband of a garment, and serves to keep the waistband flat across the front and sides of the garment as the wearer sits, squats, and/or bends at the waist. The waistband is precluded from gathering or wrinkling circumferentially and is held in a flat, unfolded state to present a smooth, clean, and finished appearance throughout the day.

The present waistband stay is preferably formed of a thin sheet of plastic material, to provide the desired flexibility over the relatively large dimension of its length while resisting bending to any significant degree across its relatively narrow width. Other materials may be used alternatively (e. g., a thin spring steel leaf, etc.), but plastic is preferred due to its light weight, economy, and corrosion resistance. Plastic is also advantageous in that it may be colored or tinted to match closely any fabric color(s) desired, or may be of transparent or translucent material, in order to blend with sheer fabrics or fabrics of different colors and shades.

The present waistband stay is removable, and is normally removed from the article of clothing before washing the clothing. A draw string hole is provided at one end of the stay, with a draw string extending therefrom. The user of the present stay need only provide a small vertical slit inside the end of the waistband near the conventional front opening of the trousers or other garment, and insert the stay therein as desired with the draw string extending slightly from the insertion slit and into the interior of the garment. The wearer may then easily withdraw the stay(s) when the garment is removed for laundering, storage, etc.

The present stay may be provided in a variety of different lengths, in order to fit various waist sizes. In one embodiment, the stay may be marked with a series of cut lines to indicate different lengths after cutting. The user need only determine the length needed, and trim the stay to the desired length as indicated by the trim or cut lines.

Accordingly, it is a principal object of the invention to provide a removably installable waistband stay for clothing, presenting a smooth, finished appearance for the garment and wearer thereof at all times and for preventing creases, wrinkles, and the like from forming circumferentially along the front and sides of the waistband of the garment.

It is another object of the invention to provide such a waistband stay which is formed of a thin, elongate, semi-flexible plastic material, but which may alternatively be formed of a thin sheet of spring steel or other material as desired.

It is a further object of the invention to provide such a waistband stay which may be colored or tinted as desired to match an article(s) of clothing, or which may be formed of transparent or translucent material for an unobtrusive appearance when used with clothing made of sheer fabrics.

Still another object of the invention is to provide such a waistband stay which includes at least one trim indicator or guide thereon, for indicating a finished length of the stay when cut or trimmed to that guide line.

Yet another object of the present invention is to provide a method of modifying an article of clothing for using the present stay therewith, and for removably installing the stay with the modified article of clothing.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a stay for removable insertion into the tubular waistband of an article of apparel (trousers, skirt, dress, shorts, etc.). The present waistband stay has a relatively inflexible width, which extends substantially across the interior width of the waistband in order to preclude the formation of circumferential, compressive or other folding or wrinkling of the waistband across its width. The present waistband stay thus assures that the apparel waistband will remain smooth and wrinkle free while the apparel is being worn, even though the wearer may not be wearing a belt with the apparel.

Figure 1:
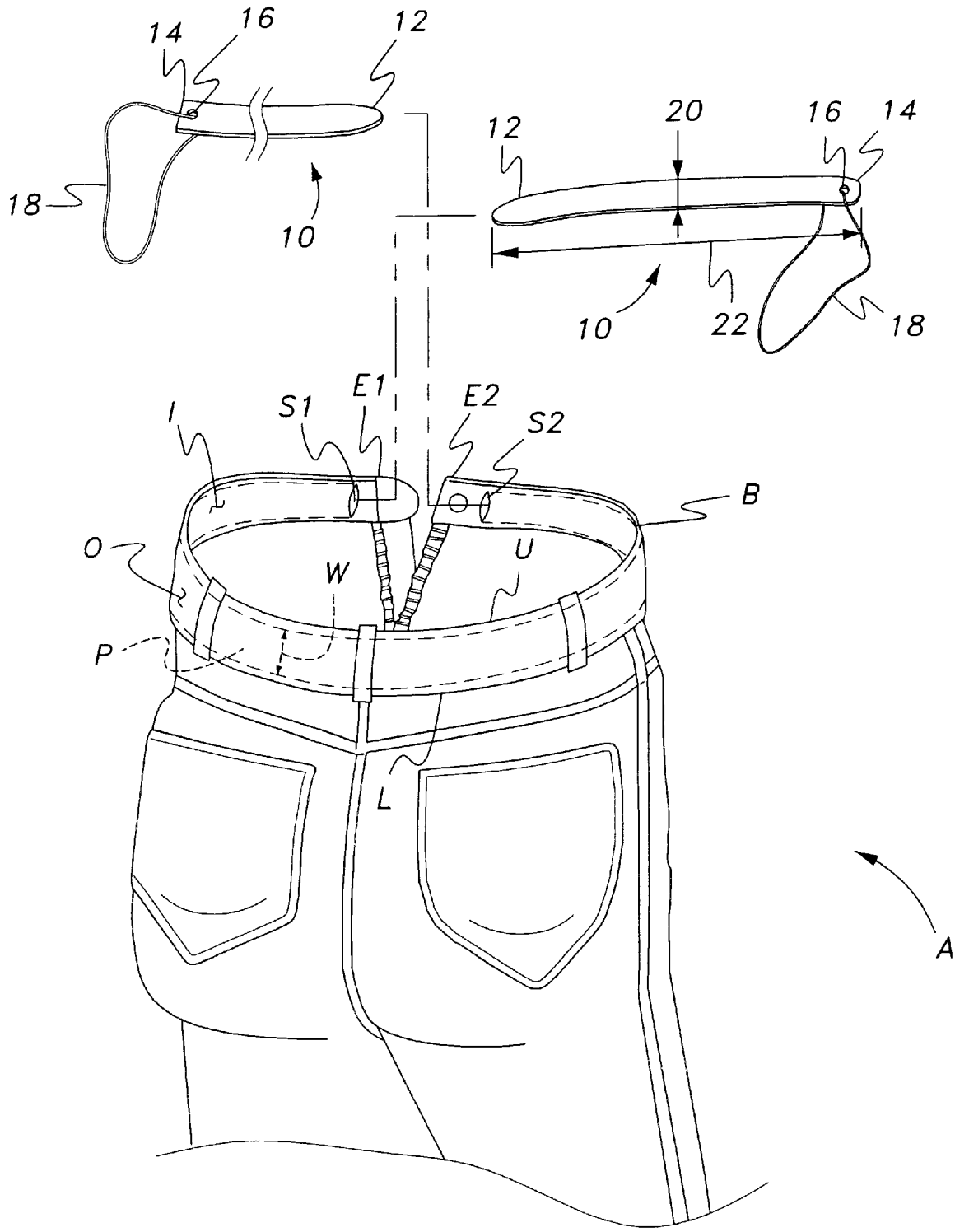
FIG. 1 is an environmental, perspective view showing the insertion of a pair of the present waistband stays into an article of clothing according to the present invention.
Figure 2:
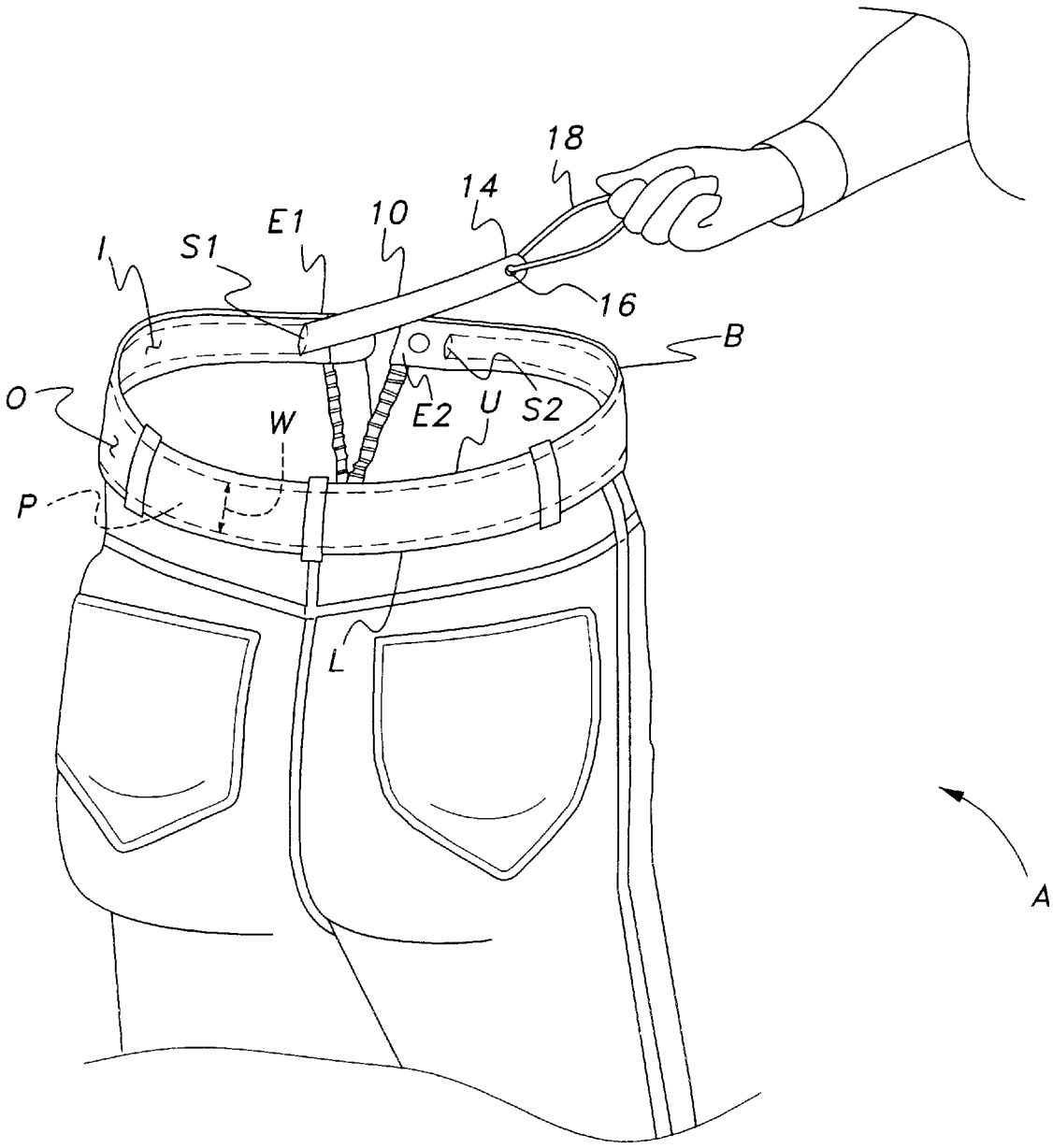
FIG. 2 is a perspective view showing the removal of one of the present waistband stays from the waistband of an article of clothing.
Figure 3:
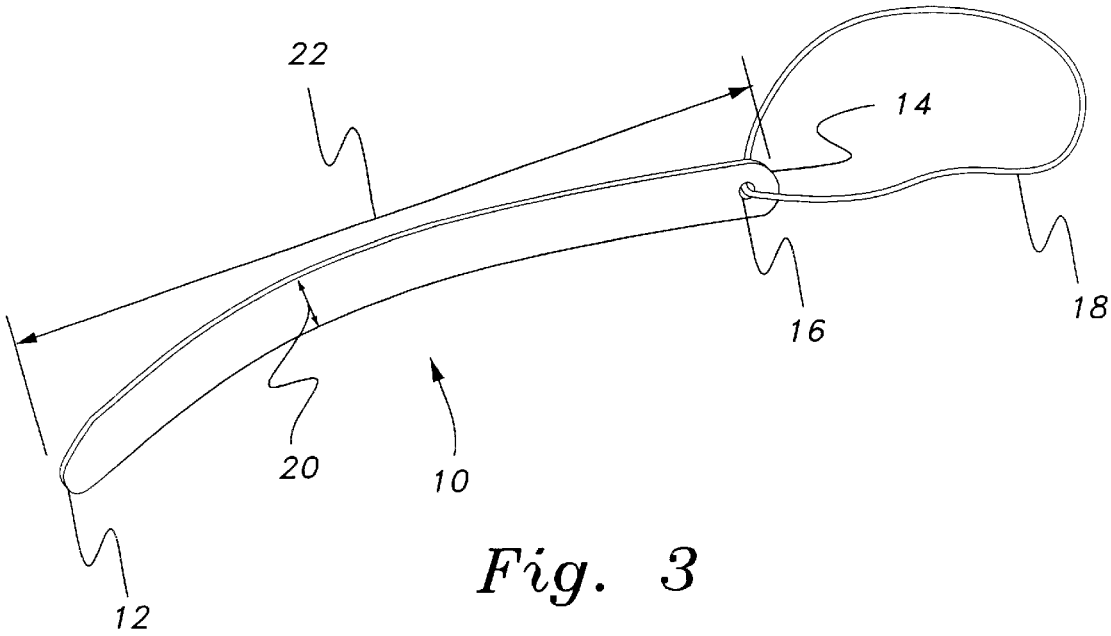
FIG. 3 is a perspective view of a first embodiment of the present waistband stay, illustrating the features thereof.
Figure 5:
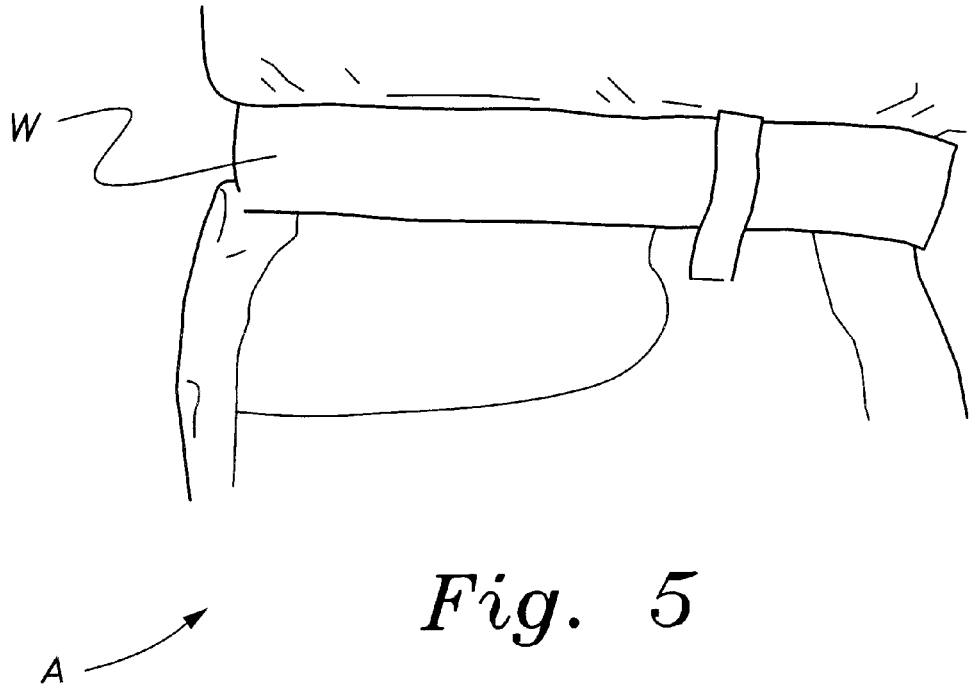
FIG. 5 is a detail perspective view of the waistband of a pair of trousers being worn, showing the smooth and finished appearance of the waistband provided by the use of the present stay.

FIG. 1 provides a perspective view showing the insertion of a pair of the present waistband stays 10 into the waistband W of an article of apparel A, with FIG. 2 showing the removal of a stay 10 from an apparel waistband B and FIG. 3 providing a more detailed perspective view of a single stay 10. The article of apparel A illustrated in FIGS. 1, 2, and 5 represents a pair of jeans or the like, and is conventional with the exception of the modification to the waistband B described further below and the removable insertion of at least one (and preferably two) of the waistband stays 10 into the waistband B. The article of apparel A may comprise a pair of shorts, or even apparel other than trousers, such as a conventional skirt or dress, etc. The present waistband stay invention is operable with any garment or article of clothing having a flat, hollow, tubular waistband construction, into which at least one of the present waistband stays 10 may be removably installed.

The conventional waistband B of the article of apparel A is formed of at least two plies of material comprising an outer panel O and an inner panel I, which may be stitched along both edges thereof, or folded over and stitched along the opposite edge thereof to define a flat, tubular structure having an interior passage P and an internal width W between the upper edge U and lower edge L thereof. The waistband B of the apparel A of FIGS. 1 and 2 is open, having a first end E1 and an opposite second end E2. This waistband construction is conventional to this point, with only minor modification being required to the apparel A in order to provide for the installation of the present waistband stay 10 or other embodiments thereof. However, it will be seen that the present waistband stays may be used with an endless or closed, waistband as well, i. e., in a garment having an elastic waist or the like, where no zipper or other closure is provided.

The waistband stay 10 of FIGS. 1 through 3 comprises an elongate, thin, somewhat flexible sheet of material. The stay 10 is preferably formed of a thin sheet of plastic material. The use of plastic provides several advantages, in that it is corrosion resistant and cannot stain clothing, and can be dyed, tinted, or colored to match or contrast with virtually any fabric color desired. Plastic material may be provided in translucent or transparent sheets as well, for virtual invisibility when used with sheer fabrics. Alternatively, other thin, flexible materials (e.g., spring steel, etc.) may be used to form the present stay 10, as desired.

The stay 10 has a first or insertion leading end 12 which is preferably smoothly tapered to a rounded point, for ease of insertion of the stay 10 into the waistband B of the apparel A. The opposite second or withdrawal end 14 includes a draw string passage 16 formed therethrough, with a draw string 18 being installed through the passage 16. The draw string 18 is preferably in the form of a continuous loop, to facilitate grasping the string 18 when removal of the stay 10 from the waistband B is desired.

The material of which the stay 10 is formed, provides essentially homogeneous properties in all directions. In other words, the stay 10 is equally flexible, per unit dimension, across its width and along its length. However, the stay 10 has a width 20 configured and dimensioned so as to fit closely across and within the internal width W of the tubular waistband B of the garment or apparel A. Thus, the waistband B cannot compress or fold laterally across its width, so long as the stay 10 with its limited flexibility across its relatively short width is installed therein. The length 22 of the stay 10 is considerably greater than its width 20, and allows the stay 10 to be flexed or curved to fit the curvature of the waistband B as it fits around the waist of a person wearing the garment or apparel A. However, the relatively short distance across the width 20 of the stay 10, greatly limits the flexibility in this direction, thereby holding the waistband B, in a flat and unfolded state across its width W and preventing folding, creasing, and/or wrinkling of the band B as the wearer of the apparel A bends and flexes at the waist.

Figure 4:
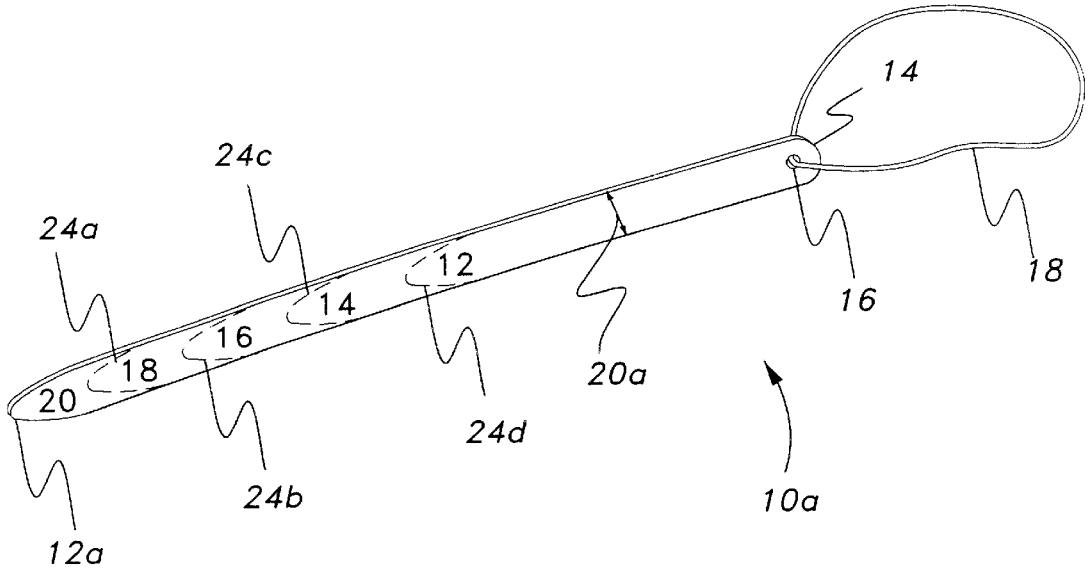
FIG. 4 is a perspective view of an alternate embodiment of the present waistband stay, showing a stay having a series of cut or trim lines marked thereon for the user to trim to a desired length.

FIG. 4 of the drawings illustrates a closely related embodiment of the waistband stay 10 of FIGS. 1 through 3, with the stay of FIG. 4 being designated as stay 10*a*. The stay 10*a* of FIG. 4 differs in only one respect from the stay 10 of FIGS. 1 through 3, in that the stay 10*a* includes at least one (and preferably a series of) trim lines, with a first trim line 24*a* being disposed adjacent the first end 12*a* and additional trim lines 24*b*, 24*c*, 24*d*, etc. being positioned across the width 20*a* of the stay 10*a* in sequence from the first trim line 24*a*. These trim lines may be designated to show the length of the stay 10*a* at that point, e. g., if the stay 10*a* is cut or trimmed along the trim line 24*b*, it will be sixteen inches long. These trim lines allow the user of the present stay 10*a* to trim the length of the stay 10*a* as desired, to fit the waistband of the apparel as desired. The trim lines 24*a*, 24*b*, etc. are preferably marked to provide the desired tapered shape of the first end 12*a* of the waistband stay 10*a*, when the user trims the stay 10*a* according to the markings of the trim lines.

In order to use the present waistband stays 10 and/or 10*a*, the apparel A must first be modified slightly by providing at least one waistband stay insertion slit across the width of the inner panel I of the waistband B. Preferably, two such slits S1 and S2 are made, respectively adjacent the first and second ends E1 and E2 of the waistband B. In the case of a closed waistband where no zipper or other separation is provided in the garment, the waistband stay insertion slit(s) may be made at any convenient location(s) along the inner panel of the waistband, as desired.

Once the slits S1 and/or S2 have been made, one (or two) of the present waistband stay(s) 10 and/or 10*a* may be inserted into the interior passage P of the waistband B. Preferably, two such slits S1 and S2 are provided adjacent each end E1 and E2 of the waistband B, as noted above. This enables the user to insert one stay 10 or 10*a* into each slit S1 and S2, from each end E1 and E2 of the waistband B. The stays 10 and/or 10*a* can be relatively short in length, and need only extend from the slit S1 (or S2) around the sides of the waistband B, with their first ends 12 (or 12*a*). extending toward the center of the back of the waistband B. However, it is not necessary that the stays extend completely to the center of the back of the waistband, as the back of the apparel A receives tensile forces when the wearer bends at the waist, rather than the compressive forces received by the front and sides of the waistband B when the wearer bends at the waist. Thus, when two such stays 10 and/or 10*a* are used, they need only have a length slightly less than half of the circumference of the waistband B of the apparel, thus facilitating the insertion of the stays.

The stays have widths which essentially span the entire interior width W of the waistband B, and the semi-rigid nature of the material of the stays prevents bending across the relatively short or narrow width thereof. Thus, it will be seen that the waistband B cannot collapse or compress across the front and sides of the wearer when the wearer bends at the waist, as the waistband stays resist compression across the width of the waistband B and maintain the waistband in a smooth and unwrinkled condition.

When the wearer of the apparel A and waistband stays wishes to remove the apparel A for laundering, etc., the present stays 10 and/or 10*a* are easily removed. The stays 10 and/or 10*a* may be inserted completely into the interior passage P of the waistband B, with the draw string 18 extending slightly from each stay insertion slit S1 and/or S2. The user need only catch the draw string loop 18 using one finger, and withdraw the stay 10 (or 10*b*) from the waistband interior passage P, generally as shown in FIG. 2 of the drawings. The waistband stay(s) 10 and/or 10*a* may thus be used in. other apparel as desired, without the wearer being required to purchase a large number of such stays for different apparel.

In conclusion, the present waistband stay invention provides a much improved appearance for the wearer of informal, beltless garments and apparel having a waistband. FIG. 5 of the drawings illustrates the smooth, finished appearance of a waistband W which is equipped with the present waistband stay(s) therein (not shown in FIG. 5, but installed as shown in FIG. 1 of the drawings). The smooth and wrinkle free appearance greatly enhances the appearance of the wearer of the apparel, providing a freshly pressed look even after the user has been wearing the apparel all day. Moreover, the present waistband stay precludes the capturing and pinching of the midriff area of the wearer between the circumferential folds and creases which otherwise occur across the front of a beltless. waistband as the wearer bends at the waist, thus providing further comfort for the wearer.

Figure 6:
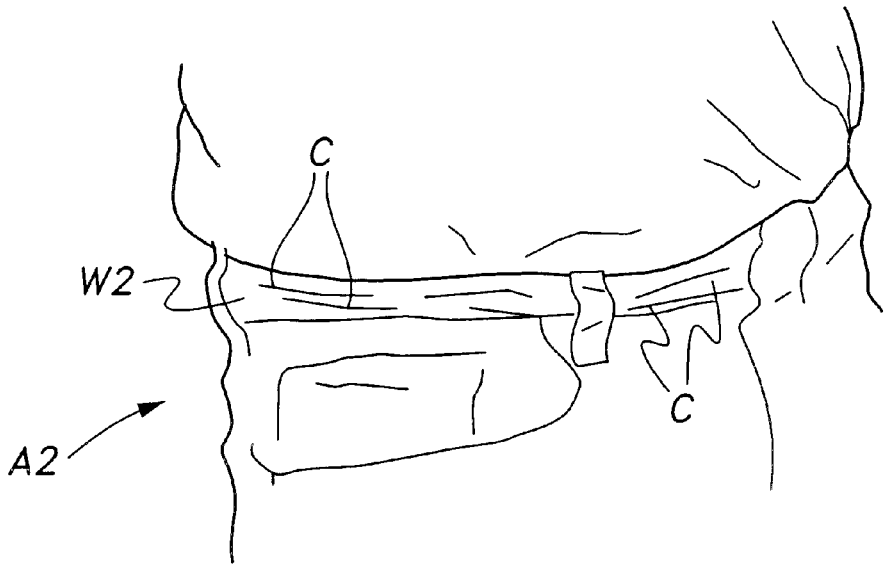
Fig. 6 PRIOR ART
FIG. 6 is a perspective view showing a pair of trousers being worn according to the prior art, with no waistband stay to prevent the circumferential wrinkling and gathering of the waistband at the front and sides.

Prior art FIG. 6 illustrates the problem which is overcome by means of the present waistband stay. With the waistband W2 being unsupported across its width, it is free to fold and wrinkle when it is compressed at the front and sides due to the wearer of the apparel A2 bending forwardly at the waist, as occurs when sitting, stooping, squatting, etc. Generally, the circumferentially disposed creases C which result from such compressive forces across the waistband W2, do not disperse when the wearer stands, as there is no tensile force to stretch the waistband W2 across its width to remove the creases C. The present waistband stay invention solves this problem by preventing such wrinkles and creases in the waistband in the first place, to provide a smooth and finished appearance at all times for the person using the present waistband stays.

It is to be understood that the present invention is not limited to the embodiments described above, but encompasses any and all embodiments within the scope of the following claims.

I claim:

1. A waistband stiffener for removable insertion within an internal width of a tubular waistband of an article of apparel, comprising:

At least one elongate, thin, semi-flexible stay having a first end and a second end opposite said first end;

said stay further having a width extending across substantially the entire internal width of the tubular waistband of the article of apparel when said stay is inserted therein;

said width of said stay having sufficient stiffness thereacross for substantially resisting bending thereacross, for precluding creasing and wrinkling across the waistband of the article of apparel when said stay is inserted therein;

said stay further having a length with sufficient flexibility therealong for bending and curving about the waistband of the article of apparel;

said first end of said stay being smoothly tapered for ease of insertion into the tubular waistband of the article of apparel;

said second end of said stay including a draw string passage formed therethrough; and a draw string extending from said draw string passage of said stay, for facilitating removal of said stay from the tubular waistband of the article of apparel.

2. The waistband stiffener according to claim 1, further including at least one trim line disposed adjacent said first end thereof.

3. The waistband stiffener according to claim 1, wherein said draw string comprises a loop passing through said draw string passage of said second end of said stay.

4. The waistband stiffener according to claim 1, wherein said stay is formed of plastic.

5. The waistband stiffener according to claim 4, wherein said plastic is selected from the group consisting of colored, translucent, and transparent plastics.

6. The waistband stiffener according to claim 1, wherein said stay is formed of metal.

7. An article of apparel and at least one removable waistband stiffener for use therewith, comprising in combination:

a garment having a flat, tubular waistband;

said waistband having an internal width;

at least one elongate, thin, semi-flexible stay having a first end and a second end opposite said first end;

said at least one stay further having a width extending across substantially the entirety of said internal width of said tubular waistband of said garment when said at least one stay is inserted therein;

said width of said at least one stay having sufficient stiffness thereacross for substantially resisting bending thereacross, for precluding creasing and wrinkling across said waistband of said garment when said at least one stay is inserted therein;

said at least one stay further having a length with sufficient flexibility therealong for bending and curving about said waistband of said garment;

said first end of said at least one stay being smoothly tapered for ease of insertion into said tubular waistband of said garment;

said second end of said at least one stay including a draw string passage formed therethrough; and a draw string extending from said draw string passage of said at least one stay, for facilitating removal of said at least one stay from said tubular waistband of said garment.

8. The article of apparel and waistband stiffener combination according to claim 7, further including at least one trim line disposed adjacent said first end of said at least one stay.

9. The article of apparel and waistband stiffener combination according to claim 7, wherein said draw string comprises a loop passing through said draw string passage of said second end of said at least one stay.

10. The article of apparel and waistband stiffener combination according to claim 7, wherein said at least one stay is formed of plastic.

11. The article of apparel and waistband stiffener combination according to claim 10, wherein said plastic is selected from the group consisting of colored, translucent, and transparent plastics.

12. The article of apparel and waistband stiffener combination according to claim 7, wherein said at least one stay is formed oft metal.

13. A method of providing a smooth and unwrinkled finish for the waistband of an article of apparel, comprising the following steps:

(a) providing an article of apparel having a flat, tubular waistband comprising an outer panel and an opposite inner panel spanning an internal width, and a first end and an opposite second end;

(b) forming a transverse stay insertion slit through the inner panel of the waistband, adjacent at least one end thereof;

(c) providing at least one elongate, thin, semi-flexible stay having a first end and a second end opposite the first end;

(d) forming the stay to have a width substantially equal to the internal width of the tubular waistband of the article of apparel;

(e) providing sufficient stiffness across the width of the stay to substantially resist bending thereacross;

(f) further providing a length for the stay, having sufficient flexibility therealong to bend and curve about the waistband of the garment; and (g) removably installing the stay within the tubular waistband of the article of apparel by inserting the stay into the at least one stay insertion slit, thereby spanning the internal width of the tubular waistband of the article of apparel with the stay and maintaining the waistband in a smooth and unwrinkled condition.

14. The method according to the method of claim 13, further including the step of smoothly tapering the first end of the stay.

15. The method according to the method of claim 13, further including the steps of:

(a) forming a draw string passage through the second end of the stay;

(b) installing a draw string through the draw string passage of the second end of the stay;

(c) allowing the draw string to extend from the stay insertion slit after installing the stay within the tubular waistband of the article of apparel; and (d) using the extended draw string for withdrawing the stay from the tubular waistband of the article of apparel, as desired.

16. The method according to the method of claim 15, further including the step of forming the draw string as a closed loop.

17. The method according to the method of claim 13, further including the steps of:

(a) providing at least one trim line disposed adjacent the first end of the stay; and (b) trimming the length of the stay as desired, using the at least one trim line provided on the stay.

18. The method according to the method of claim 13, further including the step of forming the stay of plastic.

19. The method according to the method of claim 18, further including the step of selecting the plastic from the group consisting of colored, translucent, and transparent plastics.

20. The method according to the method of claim 13, further including the step of forming the stay of metal.

* * * * *